US012163307B2

(12) United States Patent
Kanniappan et al.

(10) Patent No.: US 12,163,307 B2
(45) Date of Patent: Dec. 10, 2024

(54) FATIGUE LIFE OPTIMIZED MODULAR BUCKET ASSEMBLY

(71) Applicant: Caterpillar Inc., Peoria, IL (US)

(72) Inventors: Gopalakrishnan Kanniappan, Tiruvannamalai (IN); David Worth, Naperville, IL (US); Nicholas John Fayville, New Underwood, SD (US); Derek D. Larimore, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 221 days.

(21) Appl. No.: 17/353,243

(22) Filed: Jun. 21, 2021

(65) Prior Publication Data

US 2022/0403616 A1 Dec. 22, 2022

(51) Int. Cl.
*E02F 3/40* (2006.01)

(52) U.S. Cl.
CPC ..... *E02F 3/40* (2013.01)

(58) Field of Classification Search
CPC . E02F 3/40; E02F 3/401; E02F 9/2883; E02F 3/60
See application file for complete search history.

(56) References Cited

U.S. PATENT DOCUMENTS 3,093,917 A * 6/1963 Schroeder ..... E02F 3/40 37/459
3,243,906 A * 4/1966 Washbond ..... E02F 3/40 37/459
3,497,973 A * 3/1970 Campbell ..... E02F 9/2816 172/701.3
3,853,232 A * 12/1974 Oke ..... E02F 3/401 37/446
4,086,712 A * 5/1978 McReynolds ..... E02F 3/401 37/444

(Continued)

FOREIGN PATENT DOCUMENTS

AU 2014292806 A1 3/2016
CN 103469843 A 12/2013

(Continued)

OTHER PUBLICATIONS

RSBM, "How to build a big excavator bucket", 2018, RSBM Excavator Attachment Suppliers, https://www.youtube.com/watch?v=d-JSU1y2nkY (Year: 2018).*

(Continued)

*Primary Examiner* — Adam J Behrens
*Assistant Examiner* — Blake E Scoville

(57) ABSTRACT

A fatigue life optimized modular bucket assembly for a work machine and a method of manufacturing thereof are disclosed. The bucket assembly includes a bucket core having a pair of side sections, a continuous wrapper, a supporting element, and a receptacle; and an extension module having a pair of side bars, a guard module, an edge module, and, optionally, a set of extension plates. The method includes prebuilding the bucket core, receiving an order, providing parts for the extension module, and assembling the bucket core and the extension module parts. The bucket assembly may include universal and customizable components without exhibiting reduction to fatigue life commonly associated with weld seams.

10 Claims, 17 Drawing Sheets

(56) References Cited

U.S. PATENT DOCUMENTS

| | | | | |
|---|---|---|---|---|
| 6,167,642 | B1 * | 1/2001 | Nardini | E02F 3/962 37/903 |
| 6,186,735 | B1 * | 2/2001 | Deyo | E02F 3/40 29/466 |
| 6,834,447 | B1 * | 12/2004 | Currey | E02F 3/40 37/379 |
| 7,266,914 | B2 | 9/2007 | Grant | |
| 8,839,534 | B2 | 9/2014 | Zeno et al. | |
| 9,719,229 | B2 * | 8/2017 | Bandou | E02F 3/40 |
| 9,856,625 | B2 * | 1/2018 | Wada | E02F 3/283 |
| 10,246,849 | B2 | 4/2019 | Marek et al. | |
| 2005/0284006 | A1 | 12/2005 | Jones | |
| 2010/0000129 | A1 * | 1/2010 | Balemi | E02F 3/3677 37/444 |
| 2016/0273185 | A1 | 9/2016 | Chabura et al. | |
| 2017/0016203 | A1 | 1/2017 | Honda | |
| 2019/0316318 | A1 * | 10/2019 | Cantu | E02F 3/3417 |

FOREIGN PATENT DOCUMENTS

| | | | | |
|---|---|---|---|---|
| JP | 5696101 82 | | 4/2015 | |
| WO | WO-2015006809 | A1 * | 1/2015 | E02F 3/342 |

OTHER PUBLICATIONS

Geith, "Geith Excavator Attachments USA Factory", May 7, 2020, Geith International, https://www.youtube.com/watch?v=NI7qHlbCIRU (Year: 2020).*

Weir, "Construction Attachments Products", 2019, ESCO Group LLC. (Year: 2019).*

Written Opinion and International Search Report for Int'l. Patent Appln. No. PCT/US2022/032623, mailed Oct. 14, 2022 (12 pgs).

* cited by examiner

FATIGUE LIFE OPTIMIZED MODULAR BUCKET ASSEMBLY

TECHNICAL FIELD

The present disclosure generally relates to a bucket for a work machine and, more particularly, to a modular bucket assembly having fatigue life optimized weld seams.

BACKGROUND

A bucket is a tool attachment commonly fitted to wheel loaders, excavators, backhoes, skid steers, and other work machines. Depending on the work machine's application, which may relate to construction, mining, agriculture, earth moving, trenching, etc., the bucket may be used to penetrate into a material, such as dirt or gravel, transport a material, dump a material, clear a worksite, and/or level a terrain, among other possible use cases. Accordingly, a bucket for a work machine may be designed to satisfy varying capacity requirements, strength requirements, functionality, and customer preferences. Given their variety, buckets are often manufactured after a customer order is placed in order to meet the customer's specific applicational needs. Unfortunately, the required processing time to manufacture a custom bucket without prebuilt components may often be unsatisfactory. For example, a turnaround time for larger sized buckets may exceed 16 weeks while many customers may expect turnaround in 6 weeks or less.

One method of reducing manufacturing time may involve separating a bucket into components, one or more of which may be generic and prebuilt. It is generally known in the art to manufacture a bucket assembly by welding together separate components. It is further known that certain features of a bucket assembly, which may include guard modules, edge modules, and side plates, may be altered in size and capacity to control or match the size and capacity of the complete assembly. However, there is a need for a modular bucket assembly and method of manufacturing thereof whereby a universal and prebuilt bucket core is welded with an elective extension module. Moreover, there is a need to resolve the reduction in fatigue life attributed to welding together separate components of a bucket assembly. For the purposes of this disclosure, fatigue life may be defined as the number of loading cycles an object or material sustains before experiencing failure of a specified nature, such as a fracture. Fatigue life may be calculated through a number of methods commonly employed in the art, including but not limited to the stress-life method, the strain-life method, and the linear-elastic fracture mechanics method; and the calculation may consider a number of factors commonly known in the art, such as but not limited to the type of loading, the magnitude of the stress or strain cycle, and the nature of the failure.

One example of relevant prior art is found in U.S. Pat. No. 8,839,534 invented by Zeno et al. and assigned to ACS Industries, Inc. (hereinafter "Zeno"), which discloses a monolithic floor for use with a hot slag bucket. In Zeno, a monolithic (i.e. continuous and homogenous) floor having varied size, thickness, and/or capacity may be welded to a bucket and provide a working edge to the bucket. However, Zeno teaches that a new bucket may be modified in order to properly integrate with monolithic floors of differing type and dimension; and/or that an existing bucket may be retrofitted and cut in order to accept the monolithic floor. Zeno thus fails to teach a modular bucket assembly comprising a universal bucket core. Furthermore, the bucket design taught by Zeno is primarily concerned with reducing warpage caused by heating and cooling from hot slag. Zeno does not address the stress concentrations arising from weld seams connecting the monolithic floor to the bucket.

Accordingly, there remains a need for a bucket assembly and method of manufacturing that modularizes a bucket assembly, enables production of both universal and customizable buckets and bucket components, and alleviates fatigue life reduction created by weld seams.

SUMMARY OF THE DISCLOSURE

According to a first aspect of the present disclosure, a bucket core for a work machine is disclosed. The bucket core comprises a pair of side sections, the side sections being spaced apart to define a width of the bucket. The bucket core comprises a continuous wrapper extending between the pair of side sections, including a substantially planar, upward sloping, upper section; an arcuate middle section; a substantially planar, downward sloping, first lower section; an obtuse bend; and a substantially planar, second lower section. The bucket core comprises a supporting element extending between the pair of side sections, the supporting element being attached to a rear of the upper section. The bucket core comprises a bracing element removably attached to the wrapper. The pair of side sections and the wrapper define a receptacle of the bucket core. Notably, one or more stress concentrations during an operation of the bucket core occur(s) on the obtuse bend.

According to a second aspect of the present disclosure, a bucket assembly for a work machine is disclosed. The bucket assembly comprises a bucket core including a pair of side sections, the side sections being spaced apart to define a width of the bucket. The bucket core comprises a continuous wrapper extending between the pair of side sections, including: a substantially planar, upward sloping, upper section; an arcuate middle section; a substantially planar, downward sloping, first lower section; an obtuse bend; and a substantially planar, second lower section. The bucket core comprises a supporting element extending between the pair of side sections, the supporting element being attached to a rear of the upper section. The pair of side sections and the wrapper define a receptacle of the bucket core. The bucket assembly further comprises an extension module attached to the bucket core. The extension module includes a pair of side bars operatively and respectively attached to the pair of side sections, the pair of side bar being spaced apart to equal the width of the bucket; a guard module extending between the pair of side sections and attached to the upper section of the wrapper; and an edge module extending between the pair of side sections and operatively attached to the second lower section of the wrapper.

According to a third aspect of the present disclosure, a method of manufacturing a bucket assembly for a work machine is disclosed. The method comprises prebuilding a bucket core; receiving an order for said bucket assembly, the order reflecting at least one custom requirement; providing a plurality of parts for manufacturing an extension module based on the at least one custom requirement; and attaching the bucket core and at least some of the plurality of parts for the extension module. The extension module includes at least one of a guard module, a pair of side bars, and an edge module.

According to a fourth aspect of the present disclosure, the step of prebuilding the bucket core further includes providing a continuous wrapper having a substantially planar, upward sloping, upper section; an actuate middle section; a substantially planar, downward sloping, first lower section; an obtuse bend, and a substantially planar, second lower section.

According to a fifth aspect of the present disclosure, the step of prebuilding the bucket core further includes attaching a supporting element to a rear of the upper section of the wrapper.

According to a sixth aspect of the present disclosure, the step of prebuilding the bucket core further includes attaching a pair of side sections to the supporting element and the wrapper, wherein the side sections are spaced apart to define a width of the bucket assembly.

According to a seventh aspect of the present disclosure, the step of prebuilding the bucket core further includes attaching a hinge plate assembly to the wrapper, wherein the hinge plate assembly is laterally positioned between the side sections and includes a pair of inner hinge plates and at least one pair of outer hinge plates.

According to an eighth aspect of the present disclosure, the step of attaching the bucket core to at least some of the plurality of parts for the extension module further includes attaching the guard module to a pair of side sections of the bucket core.

According to a ninth aspect of the present disclosure, the step of attaching the bucket core to at least some of the plurality of parts for the extension module further includes attaching the edge module to a pair of side sections of the bucket core.

According to a tenth aspect of the present disclosure, the step of attaching the bucket core to at least some of the plurality of parts for the extension module further includes attaching the pair of side bars to the guard module and the edge module.

According to an eleventh aspect of the present disclosure, the step of attaching the bucket core to at least some of the plurality of parts for the extension module further includes attaching the pair of side extension plates to the guard module and the first edge extension plate.

According to a twelfth aspect of the present disclosure, the step of prebuilding the bucket core further includes removably attaching a bracing element to the wrapper.

According to a thirteenth aspect of the present disclosure, the bracing element is removably attached to the upper section via a bolt and removably attached to the second lower section via a clamp.

According to a fourteenth aspect of the present disclosure, the step of attaching the bucket core to at least some of the plurality of parts for the extension module further includes removing the bracing element from the wrapper before attaching the bucket core to at least some of the plurality of parts for the extension module.

These and other aspects and features of the present disclosure will be more readily understood after reading the following description in conjunction with the accompanying drawings.

DETAILED DESCRIPTION

Figure 1:
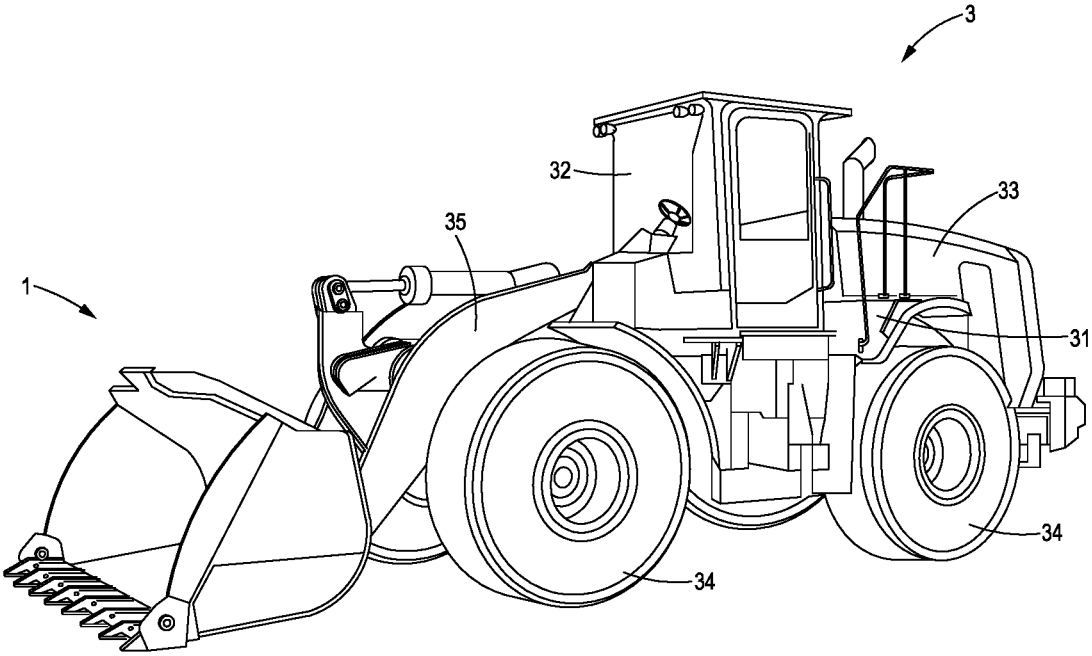
FIG. 1 is a perspective view of a work machine according to one embodiment of the present disclosure.

Referring now to the drawings and with specific reference to FIG. 1, a perspective view of a work machine constructed in accordance with the present disclosure is generally referred to by a reference numeral 3. It should be understood that the numbers included in each of the figures are for reference only and that the referenced features may be the same or may be different depending on the particular embodiment of the present disclosure. The work machine 3 is depicted as a front-end wheel loader, but may alternatively be a different type of wheel loader, an excavator, backhoe, skid steer, mining shovel, or other work machine which comprises a bucket. The work machine 3 may include a frame 31, a cabin 32 supported by the frame 31, an engine or power unit 33 supported by the frame 31, and a locomotive device 34 supporting the frame 31 and being operatively driven by the power unit 33. In particular, the locomotive device 34 may feature the wheels and tires as shown, or may engage the ground in a separate fashion, such as by employing crawler belts, tracks, treads, or the like, in order to propel the work machine 3.

The work machine 3 may further include an implement arm 35 attached to the frame 31 at a proximal end and attached to a bucket assembly 1 at a distal end. While the implement arm 35 is depicted as a boom in the exemplary embodiment, it may instead comprise a stick, a lift arm, one or more actuating cylinders, one or more linkages, and/or a combination thereof, depending on the specific work machine 3. The work machine 3 may be employed in a number of operations which utilize the bucket assembly 1, for example in construction, agricultural, mining, or earth moving contexts, in order to dig, scoop, lift, transport, lower, dump, grade, and/or level a variety of materials.

Figure 2:
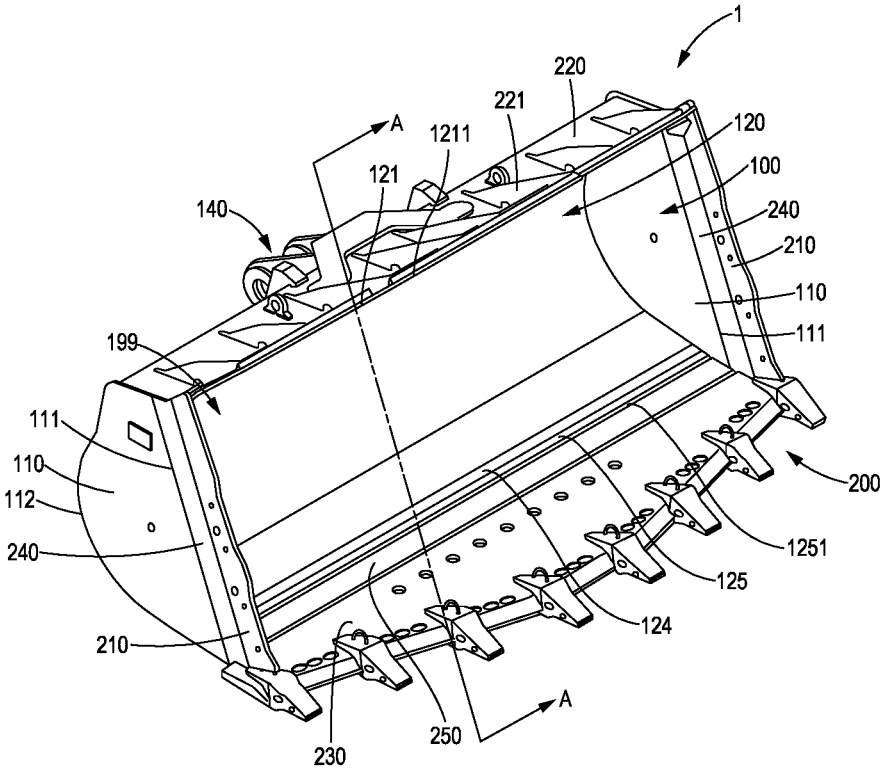
FIG. 2 is a front perspective view of a bucket assembly according to another embodiment of the present disclosure.

Turning now to FIG. 2, a detailed perspective view of the bucket assembly 1 is shown. The bucket assembly 1 may comprise a variety of dimensions, volume and weight capacities, strength grades, functionality, and/or other features depending on specific applicational requirements. Consequently, to improve a modularity and decrease a manufacturing time of the bucket assembly 1, the bucket assembly 1 may be separated into a bucket core 100 and an extension module 200. The bucket core 100 may be a "universal" component, i.e. it may be common across some or all bucket assemblies 1. The extension module 200 may be a "customizable" component, i.e. it may be unique to one or some bucket assemblies 1. Accordingly, in different embodiments the extension module 200 may be configured with varying designs, dimensions, and materials depending on specific applicational requirements. Generally speaking, the bucket core 100 may be manufactured and stocked prior to an order, such as a customer order, whilst the extension module 200 may be manufactured after. In some embodiments, however, the extension module 200 and/or its parts may be manufactured to predate the customer order as well.

Figure 5:
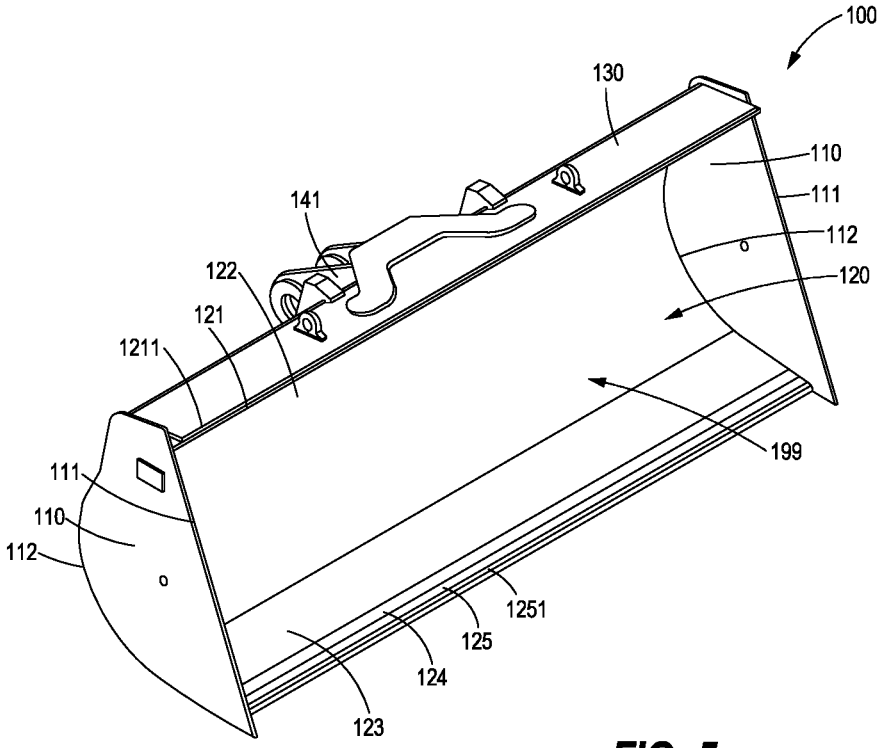
FIG. 5 is a front perspective view of a bucket core according to another embodiment of the present disclosure.

Turning now to FIG. 5, a perspective view of the bucket core 100 is shown. The bucket core 100 may include a pair of side sections 110. The pair of side sections 110 may be parallel and spaced apart to define a width of the bucket. A front profile 111 of the side sections 110 may partly define an opening of the bucket core 100, while a rear profile 112 may substantially match a shape and curvature of a continuous wrapper 120. The continuous wrapper 120 may extend laterally between the pair of side sections 110 and may include an upper section 121, middle section 122, first lower section 123, bend 124, and second lower section 125. In the context of this disclosure, the term "continuous" may refer to a body formed from a single piece of substantially uniform material or multiple pieces of material, which pieces of material may be substantially uniform in dimensions and/or properties. A continuous wrapper may have one or more openings, for example, to permit fluid-soaked material to drain, or to lighten the weight of the wrapper.

Figure 4:
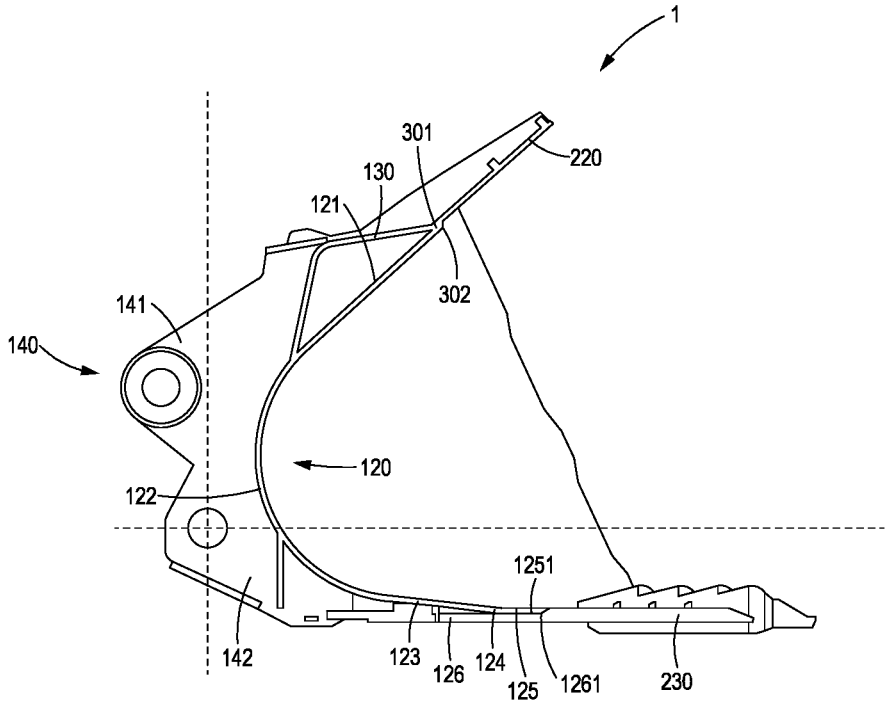
FIG. 4 is a section view of the bucket assembly shown in FIG. 2 along a section line A-A'.

The anatomy of the wrapper 120 may be best visualized in FIG. 4, which shows a section view of the entire bucket assembly 1 along a section line A-A' of FIG. 2. As seen in FIG. 4, the upper section 121 may be substantially linear in section (and planar in shape) and upward sloping; the middle section 122 may be substantially arcuate in section; the first lower section 123 may be substantially linear in section (and planar in shape) and downward sloping; the bend 124 may form an obtuse angle; and the second lower section 125 may be substantially linear in section (and planar in shape) and may be parallel to the ground when the bucket assembly 1 is in a neutral position. In some embodiments, the bucket core 100 may further include a paddle plate 126 extending from a bottom of the first lower section 123 and substantially parallel to the second lower section 125 of the wrapper 120.

Returning now to FIG. 5, a distal end 1211 of the upper section 121 and a distal end 1251 of the second lower section 125 of the wrapper 120 may partly define an opening of the bucket core 100. Moreover, the pair of side sections 110 and the continuous wrapper 120 may define a receptacle 199 of the bucket core 100.

Figure 6:
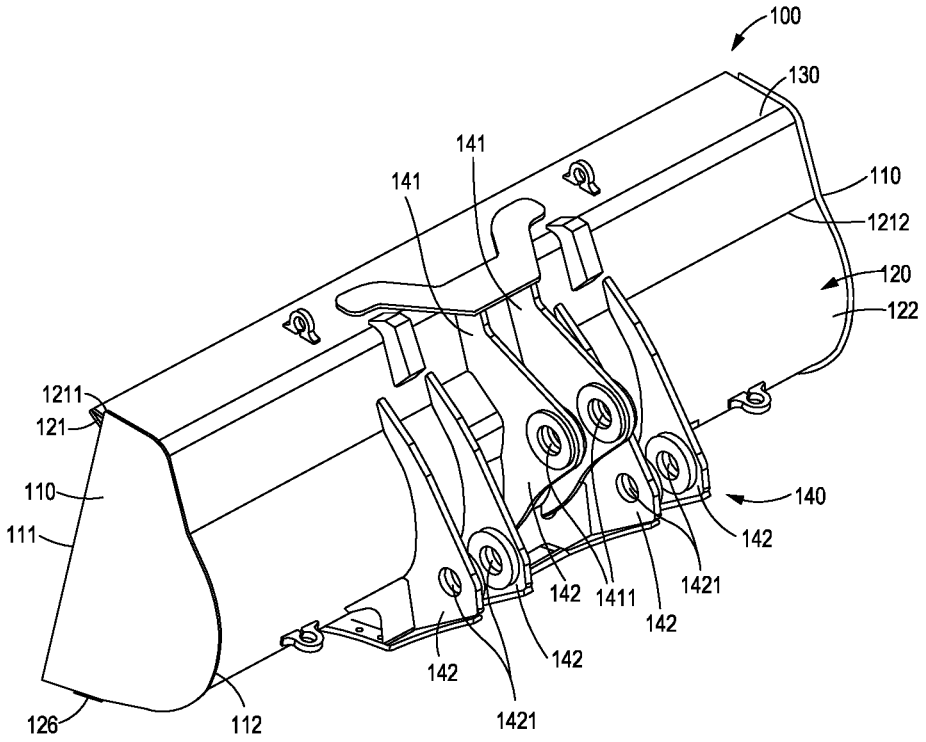
FIG. 6 is a rear perspective view of the bucket core shown in FIG. 5.

FIG. 6 is a rear perspective view of the bucket core 100. As shown, the bucket core 100 may further include a supporting element 130 laterally extending between the pair of side sections 110. The supporting element 130 may be obtuse in shape and may structurally brace the continuous wrapper 120 and, more specifically, the upper section 121 of the wrapper 120. In an embodiment, the supporting element 130 may be attached to a rear of the upper section 121 along its distal end 1211 and along its proximal end 1212, i.e. where the linear upper section 121 meets the arcuate middle section 122 of the wrapper 120.

In some embodiments, the bucket core 100 may further comprise a hinge plate assembly 140 laterally positioned between the pair of side sections 110 and attached to the wrapper 120 and/or the supporting element 130. The hinge plate assembly 140 may include a pair of inner hinge plates 141, each inner hinge plate 141 including a bore 1411; and at least one pair of outer hinge plates 142, each outer hinge plate 142 including a bore 1421. The pair of inner hinge plates 141 and their bores 1411 may be axially aligned and configured to receive and support a stick pin (not shown) in connection with the implement arm 35 of the work machine 3. Similarly, the at least one pair of outer hinge plates 142 and their bores 1421 may be axially aligned and configured to receive and support an actuator pin (not shown) in connection with the implement arm 35 of the work machine 3.

In various embodiments, and by way of non-limiting example, the pair of side sections 110, wrapper 120, supporting element 130, and hinge plate assembly 140 may be formed of steel, chromium carbide, or another desired material. One or more such components may be made of different material(s) than other such components, as well as combinations of different materials. To assemble the bucket core 100, each of the components may be welded or otherwise connected together as known in the art. In some embodiments, the bucket core 100, including the pair of side sections 110, the wrapper 120, and the supporting element 130, may be fully welded before the core 100 is attached to the extension module 200 or to at least some of a plurality of parts of the extension module 200.

Figure 7:
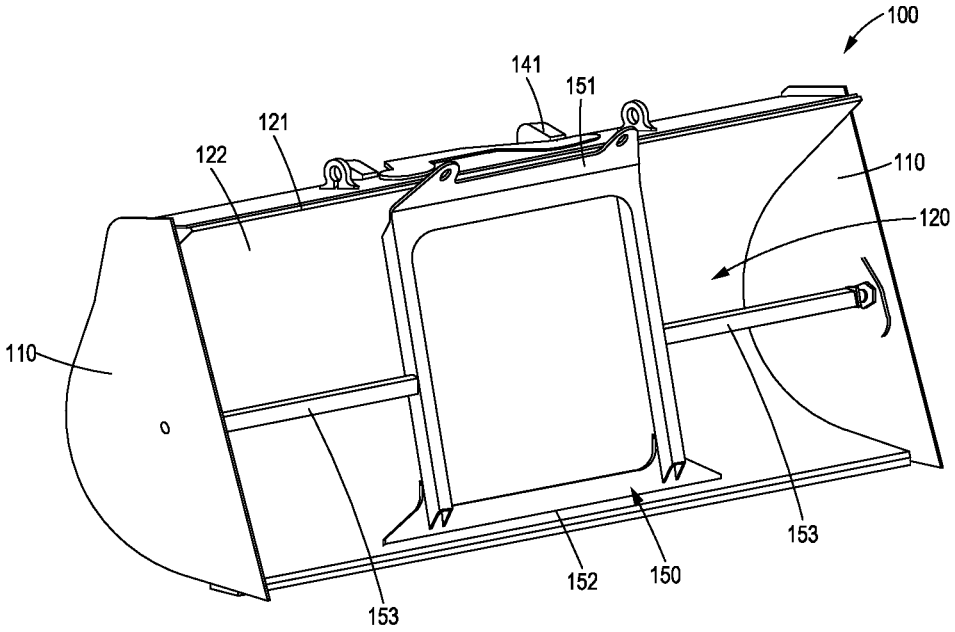
FIG. 7 is a front perspective view of a bracing element removably attached to the bucket core according to another embodiment of the present disclosure.

Turning now to FIG. 7, in some embodiments, a bracing element 150 may be removably attached to the bucket core 100. The bracing element 150 may include an upper frame 151, a lower frame 152, and a pair of side frames 153, which together provide structural support to the bucket core 100. It should be understood that the bracing element 150 is a temporary structure only and may be employed, for example, during a storage phase or a transportation phase of the bucket core 100. In some embodiments, the bracing element 150 may be removably attached before the bucket core 100 is fully welded together and, in other embodiments, the bracing element 150 may be removably attached after. The bracing element 150 may be subsequently removed prior to attachment between the bucket core and the extension module 200. In an embodiment, the upper frame 151 may be tack-welded onto the upper section 121 of the wrapper 120 and the lower frame 152 may be tack-welded onto at least one of the first lower section 123, the obtuse bend 124, and the second lower section 125. In other embodiments, the upper frame 151 may be bolted onto the upper section 121 and the lower frame 152 may be clamped onto at least one of the first lower section 123, the obtuse bend 124, and the second lower section 125. And in yet other embodiments, the bracing element 150 may be removably attached to the bucket core 100 according to other methods common to the art.

As previously discussed, the bucket core 100 may constitute a universal component of the bucket assembly 1 and may be generic across a number of bucket assembly 1 designs and use cases. To customize the final bucket assembly 1, the bucket core 100 may be fitted with an extension module 200 which dictates the depth, volume/weight capacity, strength, functionality, and/or other customizable features of the bucket assembly 1. As best seen in FIG. 2, the extension module 200 may comprise a pair of side bars 210; a guard module 220; and/or an edge module 230. In some embodiments, the extension module 200 may further comprise a pair of side extension plates 240; a first edge extension plate 250; and/or a second edge extension plate 260 (not shown).

Figure 8:
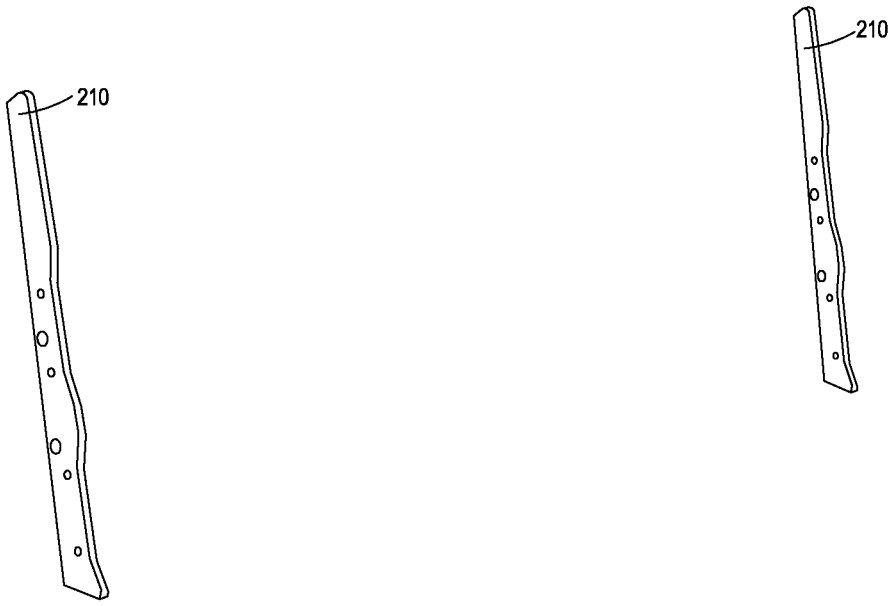
FIG. 8 is a perspective view of a pair of side bars according to another embodiment of the present disclosure.

FIG. 8 is a perspective view of the pair of side bars 210 of the extension module 200. The pair of side bars 210 may be operatively and respectively attached to the pair of side sections 110 along the front profile 111. In some embodiments, the pair of side bars 210 may be directly welded to the pair of side sections 110. It may be understood that, after attachment, the pair of side bars 210 may partly define an opening of the bucket assembly 1 and may partly dictate its depth, volume/weight capacity, strength, functionality, and/or other customizable features.

Figure 3:
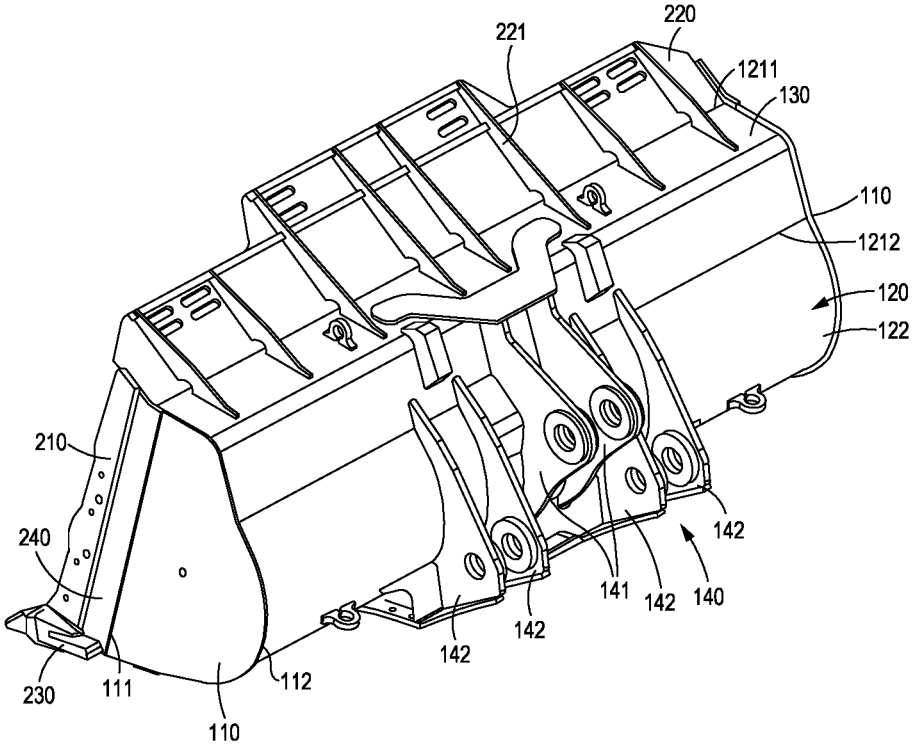
FIG. 3 is a rear perspective view of the bucket assembly shown in FIG. 2
Figure 9:
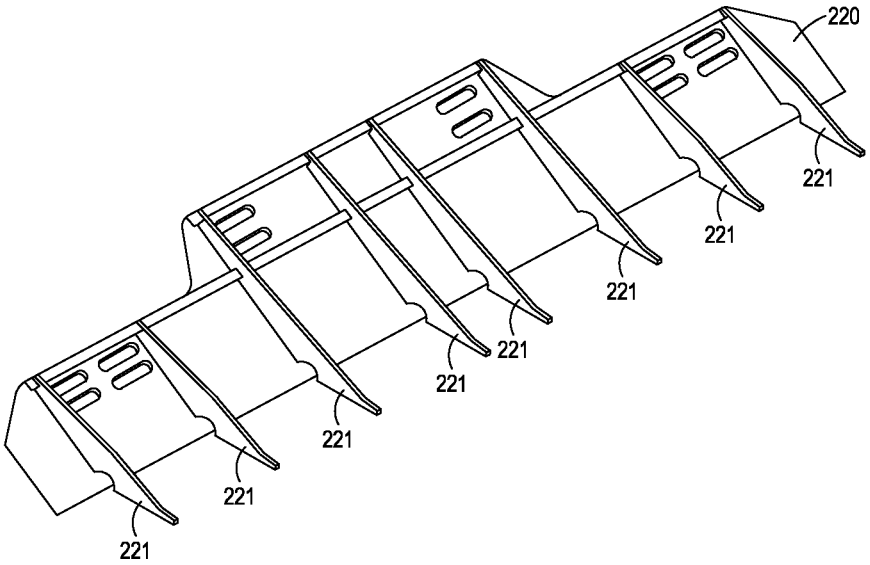
FIG. 9 is a perspective view of a guard module according to another embodiment of the present disclosure.

FIG. 9 is a perspective view of the guard module 220 of the extension module 200. The guard module 220 may extend between the pair of side sections 110 and may be operatively attached to the upper section 121 of the wrapper 120. More specifically, as best seen in FIG. 3, which shows a rear perspective view of the bucket assembly 1, the guard module 220 may be attached to the supporting element 130 and a distal end 1211 of the upper section 121. In some embodiments, the guard module 220 may further be attached to the side sections 110. In some embodiments, the guard module 220 may feature a series of gussets 221 extending from a rear of the guard module 220 and attached to the supporting element 130. The guard module 220 and the series of gussets 221 may provide structural support to the bucket assembly 1 and may further protect the bucket assembly 1 from rocks and other debris. It may be understood that, after attachment, the guard module 220 may partly define an opening of the bucket assembly 1 and may partly dictate its depth, volume/weight capacity, strength, functionality, and/or other customizable features.

Figure 10:
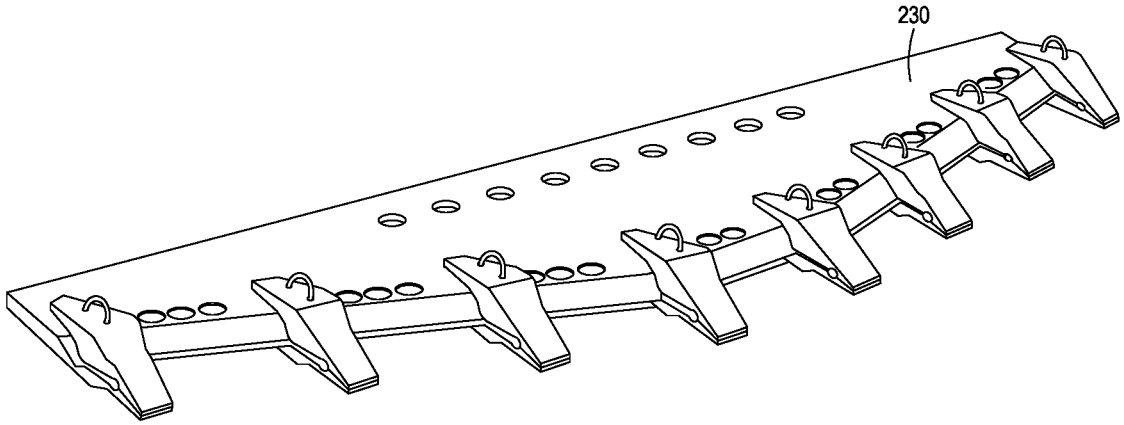
FIG. 10 is a perspective view of an edge module according to another embodiment of the present disclosure.

FIG. 10 is a perspective view of the edge module 230 of the extension module 200. The edge module 230 may extend between the pair of side sections 110 and may be operatively attached to the second lower section 125 of the wrapper 120. More specifically, as best seen in FIG. 2, the edge module 230 may be operatively attached to at least a distal end 1251 of the second lower section 125 and a distal end 1261 of the paddle plate 126. In some embodiments, the edge module 230 may further be attached to the side sections 110.

In various embodiments, the edge module 230 may feature different topologies, e.g. may be planar or sloping; may feature different profiles, e.g. may be rectangular, triangular, or arcuate in shape; may include teeth or a flat cutting edge; and may include yet other features depending on specific applicational requirements. In some embodiments, the edge module 230 represents the component of the extension module 200 with the greatest flexibility in design and the greatest influence to the customization of the bucket assembly 1 as a whole. It may be understood that, after attachment, the edge module 230 may partly define an opening of the bucket assembly 1 and may partly dictate its depth, volume/weight capacity, strength, functionality, and/or other customizable features.

Figure 11:
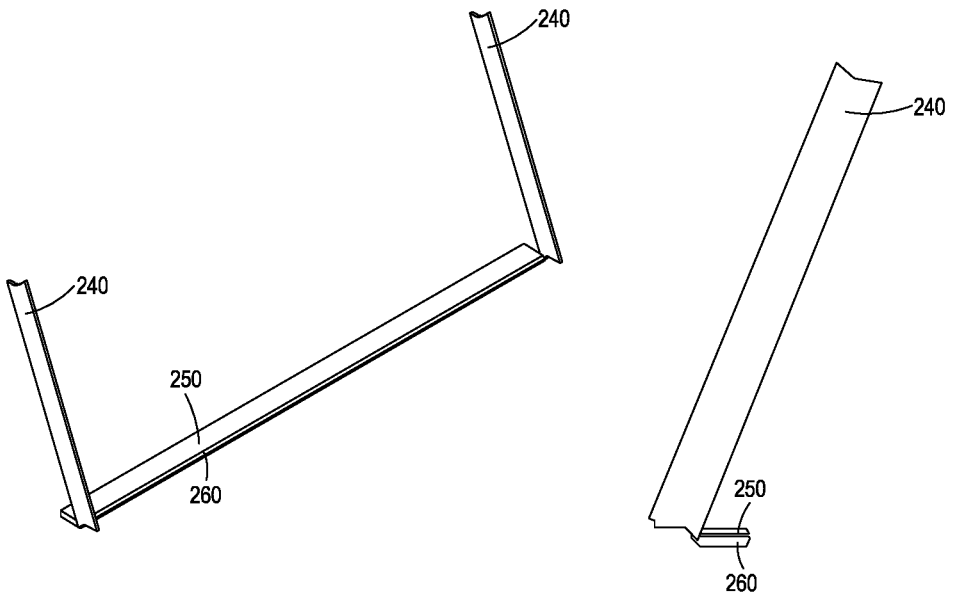
FIG. 11 is a perspective view of a pair of side extension plates, a first edge extension plate, and a second extension plate according to another embodiment of the present disclosure.

Referring now to FIG. 11, the extension module 200 may further include extension plates, including a pair of side extension plates 240, a first edge extension plate 250, and a second edge extension plate 260. The extension plates 240, 250, 260 may be attached to and between the bucket core 100 and the above-described components of the extension module 200 to further customize the dimensions and/or functionality of the final bucket assembly 1. More specifically, as best seen in FIG. 2, the pair of side extension plates 240 may be respectively attached to and between the front profile 111 of the pair of side sections 110 and the pair of side bars 210. The first edge extension plate 250 may be attached to and between a distal end 1251 of the second lower section 125 and the edge module 230. The second edge extension plate 260 (not shown) may be attached to and between a distal end 1261 of the paddle plate 126 (not shown) and the edge module 230. Where applicable, the first edge extension plate 250 may further be attached to the side extension plates 240. In some embodiments, the extension plates 240, 250, 260 may be dimensioned to substantially match that of their adjoining components. For example, a length of the pair of side extension plates 240 may substantially equal to a length of the front profile 111 and/or a length of the pair of side bars 210. However, it may be understood that a width and/or thickness of the extension plates 240, 250, 260 may be adjusted in different embodiments. After attachment, the extension plates 240, 250, 260 as a whole may partly dictate a depth, volume/weight capacity, strength, functionality, and/or other customizable features of the bucket assembly 1.

In various embodiments, the components of the extension module 200, including the pair of side bars 210, the guard module 220, the edge module 230, and/or the extension plates 240, 250, 260 may be formed of steel, chromium carbide, or another desired material. One or more such components may be made of different material(s) than other such components, as well as combinations of different materials. To complete the bucket assembly 1, each of the components may be fully welded to the bucket core 100.

Figure 12:
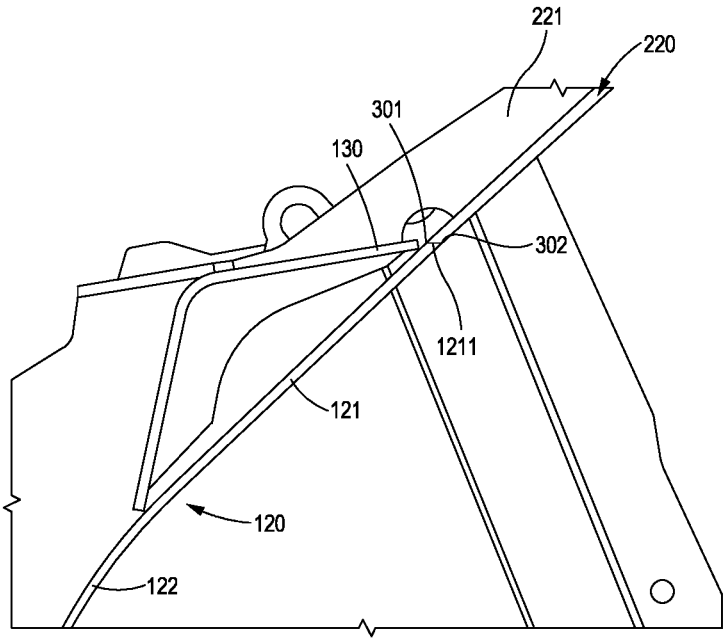
FIG. 12 is a detailed close-up of a portion of the sectional view shown in FIG. 4 showing one or more weld seams between the bucket core and the guard module.

FIG. 12 is a detailed close-up of a portion of the section view shown in FIG. 4, wherein one or more weld seams connecting the guard module 220 to the upper section 121 of the wrapper 120 may be observed. In particular, the guard module 220 may be welded to the distal end 1211 of the upper section 121 along a first weld seam 301 and along a second weld seam 302. In some embodiments, the guard module 220 and, more specifically, the series of gussets 221 may further be welded to the supporting element 130 or otherwise connected as known in the art.

Figure 13:
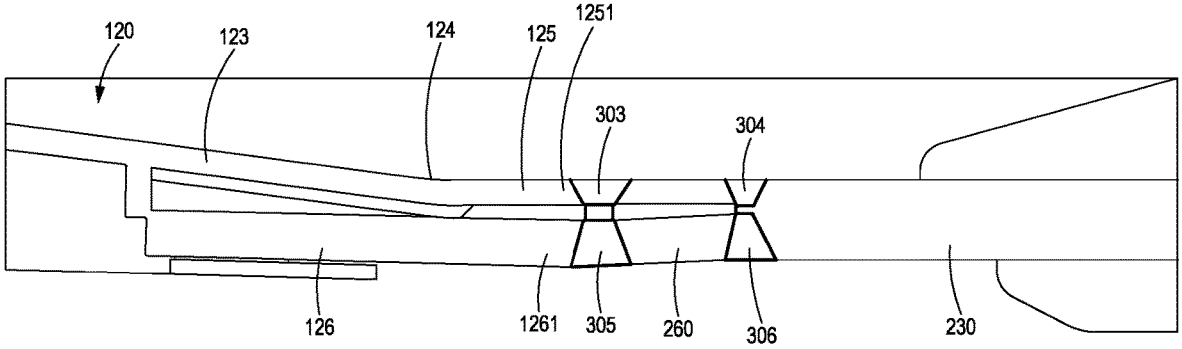
FIG. 13 is a detailed close-up of another portion of the sectional view shown in FIG. 4 showing one or more weld seams between the bucket core and the edge module.
Figure 14A:
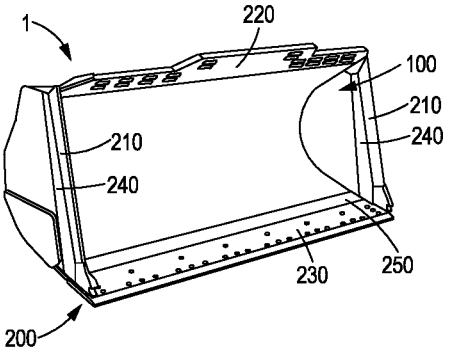
FIG. 14A is a perspective view of a completed bucket assembly according to another embodiment of the present disclosure.
Figure 14B:
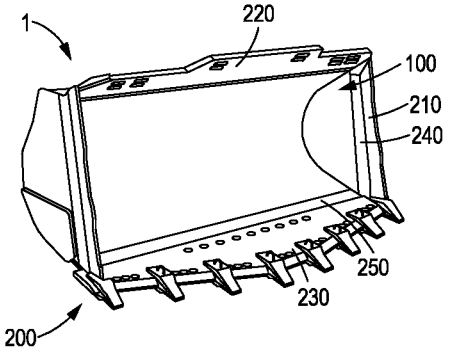
FIG. 14B is a perspective view of a completed bucket assembly according to another embodiment of the present disclosure.
Figure 14C:
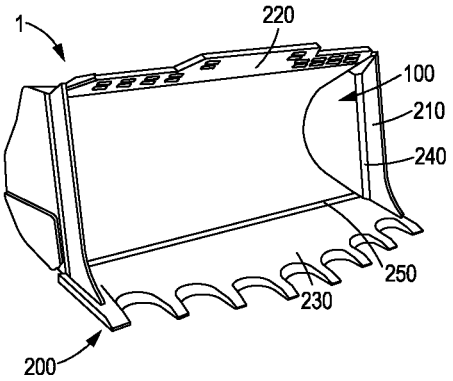
FIG. 14C is a perspective view of a completed bucket assembly according to another embodiment of the present disclosure.
Figure 14D:
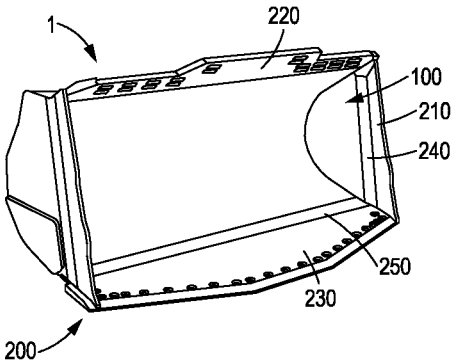
FIG. 14D is a perspective view of a completed bucket assembly according to another embodiment of the present disclosure.

FIG. 13 is a detailed close-up of another portion of the section view shown in FIG. 4, wherein one or more weld seams connecting the edge module 230 to the second lower section 125 of the wrapper 120 may be observed. Also shown in greater detail is the paddle plate 126, which may extend from the first lower section 123 of the wrapper 120. In the embodiment shown, the first edge extension plate 250 and second edge extension plate 260 may be attached to and between the wrapper 120 and the edge module 230. More specifically, the first edge extension plate 250 may be welded to a distal end 1251 of the second lower section 125 along a third weld seam 303 and may be welded to the edge module 230 along a fourth weld seam 304. The second edge extension plate 260 may be welded to a distal end 1261 of the paddle plate 126 along a fifth weld seam 305 and may be welded to the edge module 230 along a sixth weld seam 306. In some embodiments of the bucket assembly 1, for example those foregoing the first edge extension plate 250 and the second edge extension plate 260, the edge module 230 may instead be directly welded to the distal end 1251 of the second lower section 125 and the distal end 1261 of the paddle plate 126. In such cases, the number of weld seams may be reduced to, for example, two weld seams instead of four. And in yet other embodiments of the bucket assembly 1, the paddle plate 126 may be forgone. In such cases, the edge module 230 may be welded only to the distal end 1251 of the second lower section 125, or where applicable, only to the first edge extension plate 250.

After attachment, the edge module 230 may be substantially parallel to the second lower section 125 and paddle plate 126 of the wrapper 120, and may be parallel to the ground when the bucket assembly 1 is in a neutral position. It may be appreciated by those in the art that stresses exerted on the edge module 230 during an operation of the bucket assembly 1 may be transferred through the edge module 230, the edge extension plates 250, 260, the weld seams 303-306, the wrapper 120, and yet other components of the bucket assembly 1. Advantageously, the designs disclosed herein may shift one or more stress concentrations exhibited during an operation of the bucket assembly 1 away from the plurality of weld seams 303-306 and into the interior of the bucket core 100. In particular, the one or more stress concentrations may be localized to the bend 124 of the wrapper 120. By incorporating the inflection point, i.e. the bend 124, within the bucket core 100, and, more specifically, on the continuous wrapper 120, a stress concentration may be thus transferred to a more durable feature of the bucket assembly 1 and a fatigue life generally improved.

Turning now to FIGS. 14A-14D, a number of complete bucket assemblies 1 are shown. As discussed, each bucket assembly 1 may comprise a universal bucket core 100 and a customizable extension module 200. In an exemplary embodiment shown in FIG. 14A, the bucket assembly 1 may be general-purpose or multi-purpose; and the extension module 200 may feature an edge module 230 with a flat cutting edge. In an exemplary embodiment shown in FIG. 14B, the bucket assembly 1 may be a digging bucket or excavator bucket; and the edge module 200 may feature an edge module 230 with an arcuate profile and a row of weld-on, bolt-on, or integral teeth. Indeed, in various embodiments envisioned by the present disclosure, the edge module 230 may feature different topologies, e.g. may be planar or sloping, may feature different profiles, e.g. may be rectangular, triangular, or arcuate; may or may not feature teeth, e.g. bolt-on, weld-on, or integral; and/or may include other features depending on specific applicational requirements, where no limitation is intended herein for their type and number. It may further be noted that the various embodiments of the bucket assembly 1 may comprise different pairs of side bars 210, guard modules 220, and extension plates 240, 250, 260. For example, the embodiment shown in FIG. 14A may include a different guard module 220 from that of FIG. 14B, the embodiment shown in FIG. 14B may include a different pair of side bars 210 from that of FIG. 14D, and the embodiment shown in FIG. 14A may include a different set of extension plates 240, 250, 260 from those of FIG. 14C. It should be appreciated that the components of each extension module 200 may, without limitation, differ in use case, design, functionality, material composition, material treatment, and yet other customizable features depending on the specific applicational requirements of that particular bucket assembly 1. In this manner, a universal bucket core 100 may be combined with a unique extension module 200 to realize a plurality of bucket assembly 1 designs.

INDUSTRIAL APPLICATION

The bucket assembly of the present disclosure may be employed in any number of work machines, including but not limited to wheel loaders, skid steers, excavators, backhoes, mining shovels, and others. In an exemplary application, the bucket assembly may be attached to an implement arm of a wheel loader, such as a Caterpillar® 988K Large Wheel Loader or a Caterpillar® 992 Large Wheel Loader. The bucket assembly may further be employed in any number of operations common to the art, including but not limited to digging, trenching, excavating, transporting, dumping, grading, leveling, and others, which may be performed in the context of agricultural, construction, mining, road building, trenching, and other work machine applications.

By employing the disclosed designs, a modular bucket assembly may be substantially customizable while avoiding increases in fabrication lead time and decreases in fatigue life. Advantageously, the bucket assembly may be separated into a universal bucket core and a customizable extension module, wherein the universal bucket core may be prebuilt and readily stocked. Accordingly, at least half and possibly upwards of three quarters of the total processing time may be completed prior to a customer order. The extension module may be custom built and may be designed to fulfill a depth, volume/weight capacity, strength, functionality, and/or other feature of the bucket assembly. Accordingly, less than half or possibly as little as a quarter of the total processing time may be required after the customer order, such that the complete bucket assembly may be manufactured, joined, and shipped in six weeks or less time. In some embodiments, certain components of the extension module, such as the guard module, the pair of side bars, or the extension plates may be prebuilt and stocked as well, achieving yet further reductions to total processing time. And in other embodiments, components of the bucket assembly may be manufactured according to business forecasts and predate the customer order altogether.

Moreover, the disclosed bucket assembly may be modularized to the above benefits without detriment or with limited detriment to fatigue life. By designing a bucket assembly with an inflection point localized to the bucket core, and specifically a bend of a continuous wrapper of the bucket core, stress concentrations during an operation of the bucket assembly may be relocated from the weld seams—areas traditionally known to concentrate stress and exacerbate fatigue. Accordingly, a fatigue life of the bucket assembly may be improved in tandem with customization.

Figure 15:
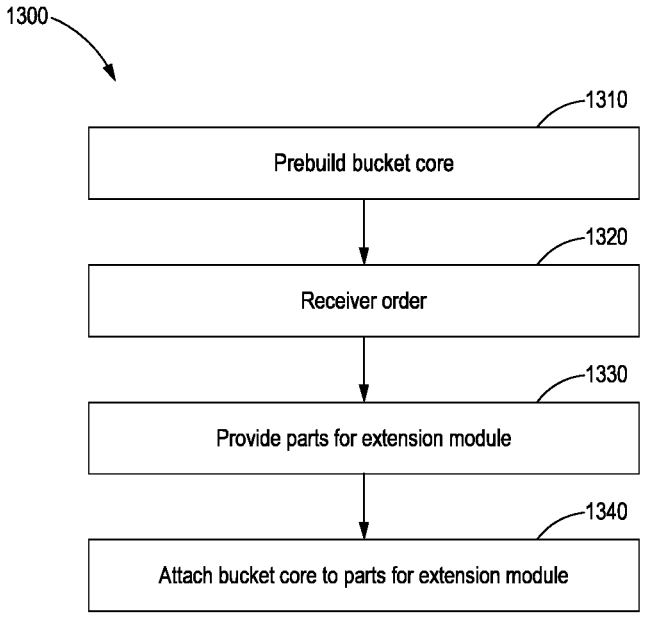
FIG. 15 is a flowchart depicting a method of manufacturing a bucket assembly according to another embodiment of the present disclosure.

Turning now to FIG. 15, a method of manufacturing a bucket assembly for a work machine is generally referred to by reference numeral 1300. In a first block 1310, a universal bucket core is prebuilt and stocked. After an order is received, wherein the order reflects at least one custom requirement (block 1320), a plurality of parts for manufacturing an extension module may be provided based on the at least one custom requirement (block 1330). The parts of the extension module may include at least one of a guard module, a pair of side bars, and an edge module. In some embodiments (not shown), certain components of the extension module, for example the guard module, the pair of side bars, or the extension plates, may also be prebuilt prior to the order. Finally, in block 1340, the bucket core and the at least some of the plurality of parts for the extension module are attached and together form the complete bucket assembly.

Figure 16:
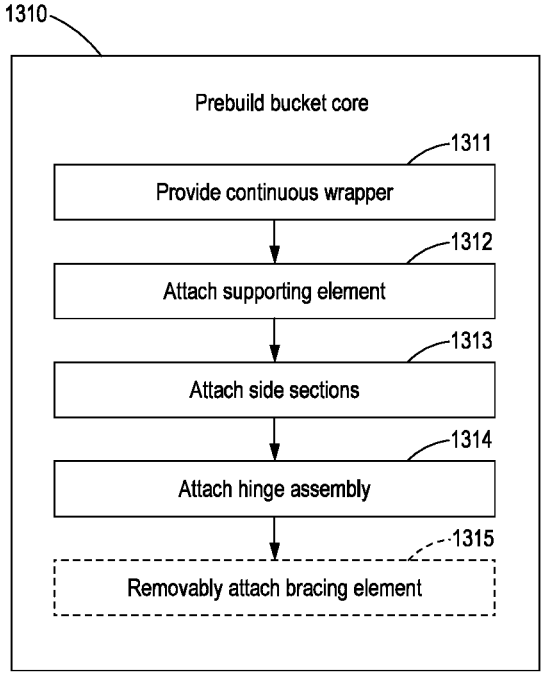
FIG. 16 is a flowchart depicting the subblocks of a step of the method depicted in FIG. 14, and specifically a step of prebuilding a bucket core.

Referring now to FIG. 16, the step of prebuilding the bucket core shown in block 1310 is broken down into more detailed subblocks. In a first subblock 1311, a continuous wrapper is provided, the continuous wrapper having a substantially planar, upward sloping, upper section; an arcuate middle section; a substantially planar, downward sloping, first lower section; an obtuse bend; and a substantially planar, second lower section. Next, a supporting element is attached to a rear of the upper section of the wrapper (block 1312); and a pair of side sections are attached to the supporting element and the wrapper, wherein the side sections are spaced apart to define a width of the bucket assembly (block 1313). In block 1314, a hinge plate assembly is attached to the wrapper. The hinge plate assembly may be laterally positioned between the side sections and may further include a pair of inner hinge plates and at least one pair of outer hinge plates.

In some embodiments, the aforementioned components of the bucket core may be attached by full welding, and may be assembled before the bucket core is attached to at least some of the parts of the extension module. In the same or other embodiments, a bracing element may be removably attached to the bucket core upon its completion to provide temporary structural support (block 1315). In various embodiments, an upper frame of the bracing element may be attached to the upper section of the wrapper via a bolt and a lower frame of the bracing element may be attached to at least one of the first lower section, the obtuse bend, and the second lower section via clamping; the upper frame and the lower frame may be tack-welded to the continuous wrapper; or the bracing element may be removably attached to the bucket core 100 according to other methods common to the art.

Figure 17:
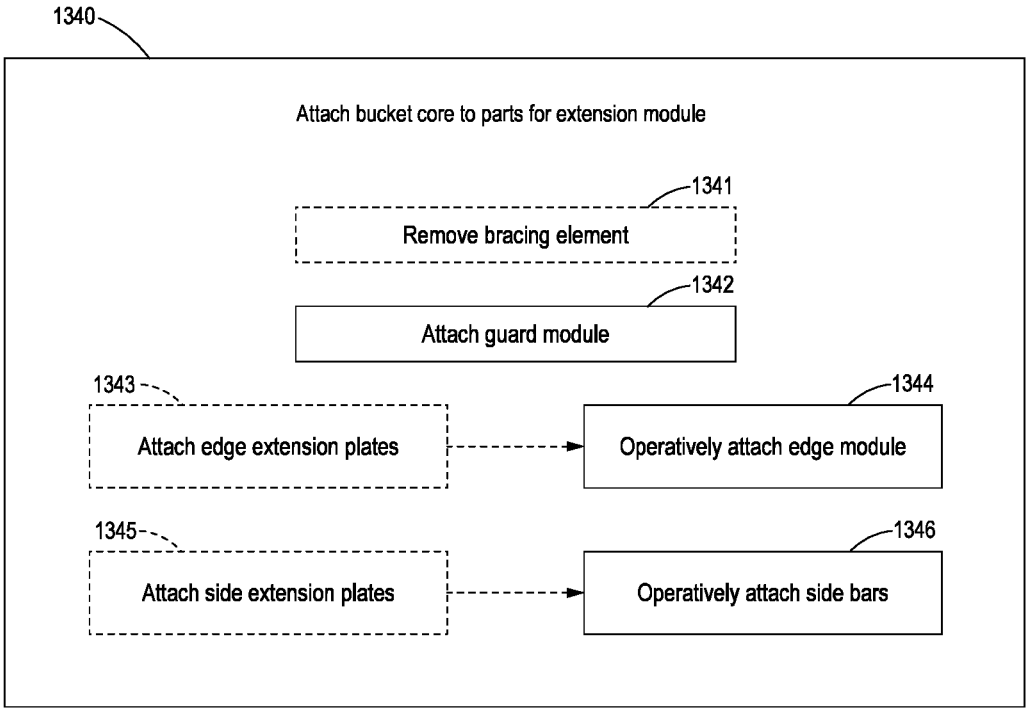
FIG. 17 is a flowchart depicting the subblocks of a step of the method depicted in FIG. 14, and specifically a step of attaching a bucket core to an extension module.

Turning now to FIG. 17, the step of attaching the bucket core to at least some of the plurality of parts for the extension module shown in block 1340 is further broken down into more detailed subblocks. In a first block 1341, where applicable, the bracing element may be removed from the continuous wrapper of the bucket core.

In block 1342, the guard module may be attached to a distal end of an upper section of the continuous wrapper. In some embodiments, the guard module may further be attached to the side sections of the bucket core. The edge module may be operatively attached to at least one of a distal end of a second lower section and to a distal end of a paddle plate of the wrapper. In some embodiments, the edge module may be directly attached to the wrapper (block 1344) or, in other embodiments, a first extension plate may be attached to and between the distal end of the second lower section and the edge module, while a second extension plate may be attached to and between the distal end of the paddle plate and the edge module (block 1343). In some embodiments, the edge module may further be attached to the side sections of the bucket core.

A pair of side bars may further be operatively and respectively attached to a pair of side sections of the bucket core and, more specifically, to a front profile of the side sections. In some embodiments, the side bars may be directly and respectively attached to the front profile of the pair of side sections (block 1346) or, in other embodiments, a pair of side extension plates may be attached to and between the pair of side sections and the pair of side bars (block 1345). In some embodiments, the side bars may further be attached to the guard module and the edge module. And in other embodiments, where applicable, the side extensions may be attached to the guard module and the first edge extension plate.

According to many embodiments, each of the above attachment steps may be effected by welding together the adjoining components, such that at least some of the plurality of parts for the extension module are fully welded to the bucket core upon completion of the bucket assembly 1.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

The invention claimed is:

1. A bucket core for a work machine comprising:

a pair of side sections, the side sections being spaced apart to define a width of the bucket;

a continuous wrapper extending between the pair of side sections, including:

a substantially planar, upward sloping, upper section;

an arcuate middle section welded to the upper section;

a substantially planar, downward sloping, first lower section fully welded to the middle section;

a solid, one-piece obtuse upward bend section fully welded to the first lower section; and a solid, one-piece substantially planar, second lower section fully welded to the obtuse upward bend section and having a distal end constructed for attachment to an edge module thereat;

a brace configured to provide structural support to the bucket core under a condition where the brace is removably attached to the continuous wrapper; and a support extending between the pair of side sections and fully contained within a boundary defined by an outward edge of the pair of side sections, the support being attached to a rear of the upper section of the continuous wrapper, wherein the continuous wrapper forms a concave, even, continuous surface defined thereover between the upper section and the middle section, and between the middle section and the first lower section, with the obtuse upward bend demarking the first lower section and the second lower section and continuous therewith, wherein the pair of side sections and the continuous wrapper define a receptacle, wherein the bucket core is constructed to distribute stress during operation of the bucket core on the obtuse upward bend, wherein a contact face of the continuous wrapper is defined by at least the arcuate middle section, the first lower section, the obtuse upward bend section, and the second lower section, is continuous from the distal end of the second lower portion to the upper section, and is exclusive of fasteners extending therethrough, and wherein the brace extends across the concave, even, continuous surface of the continuous wrapper and includes:

a frame attached to the upper section and attached to the first lower section, the obtuse bend, and/or the second lower section, and a pair of side frames connecting the frame to the pair of side sections.

2. A method of manufacturing a bucket assembly for a work machine comprising:

prebuilding a bucket core from a pair of side sections, a continuous wrapper extending between the pair of side sections, and a supporting element extending between the pair of side sections on an upper section of the continuous wrapper, the wrapper forming a concave, even, continuous surface defined thereover between an upper section and a middle section, and between the middle section and a first lower section, with an obtuse bend demarking the first lower section and a second lower section and continuous therewith;

rigidly attaching a bracing element to the bucket core across the concave surface of the wrapper subsequently to the prebuilding of the bucket core, the bracing element including a frame attached to the upper section and at least one of the first lower section, the obtuse bend, and the second lower section, a pair of side frames connecting the frame to the pair of side sections, receiving an order for the bucket assembly, the order reflecting at least one custom requirement;

providing a plurality of parts for manufacturing an extension module based on the at least one custom requirement; and attaching the bucket core and at least some of the plurality of parts for the extension module, the attaching of the bucket core to the extension module being solely at the second lower section, wherein the extension module includes at least one of a guard module, a pair of side bars, and an edge module, and wherein a contact face of the continuous wrapper is defined by at least the arcuate middle section, the first lower section, the obtuse upward bend section, and the second lower section, is continuous from the distal end of the second lower portion to the upper section, and is exclusive of fasteners extending therethrough.

3. The method according to claim 2, the step of attaching the bucket core and at least some of the plurality of parts for the extension module further including:

attaching the guard module to a distal end of the upper section of the continuous wrapper of the bucket core.

4. The method according to claim 2, the step of attaching the bucket core and the at least some of the plurality of parts for the extension module further including:

operatively attaching the edge module to at least one of a distal end of the second lower section and to a distal end of a paddle plate of the continuous wrapper of the bucket core.

5. The method according to claim 2, the step of attaching the bucket core and at least some of the plurality of parts for the extension module further including:

operatively and respectively attaching the pair of side bars to the pair of side sections of the bucket core.

6. The method according to claim 4, the step of attaching the bucket core and at least some of the plurality of parts for the extension module further including:

attaching an edge extension plate to and between the distal end of the paddle plate and the edge module prior to attaching the edge module.

7. The method according to claim 5, the step of attaching the bucket core and at least some of the plurality of parts for the extension module further including:

attaching respectively a pair of side extension plates to and between the pair of side sections and the pair of side bars prior to attaching the pair of side bars.

8. The method according to claim 2, wherein the bucket core is fully welded before the step of attaching the bucket core to at least some of the plurality of parts for the extension module.

9. The method according to claim 2, the step of attaching the bucket core to at least some of the plurality of parts for the extension module further including:

fully welding the plurality of parts for the extension module to the bucket core.

10. The method of claim 2, further comprising welding the supporting element between the pair of side sections and laterally contained therebetween, the supporting element being attached to a rear of the upper section of the continuous wrapper at distal and proximal edges thereof.

* * * * *